United States Patent [19]

Theurer et al.

[11] 4,261,264

[45] Apr. 14, 1981

[54] MOBILE TRACK TIE TRANSPORT APPARATUS WITH TRAVELING GANTRY

[75] Inventors: Josef Theurer, Vienna; Manfred Brunninger, Linz, both of Austria

[73] Assignee: Franz Plasser Bahnbaumaschinen-Industriegesellschaft m.b.H., Vienna, Austria

[21] Appl. No.: 31,044

[22] Filed: Apr. 18, 1979

[30] Foreign Application Priority Data

Jun. 6, 1978 [AT] Austria ..... 4115/78

[51] Int. Cl.[3] ..... E01B 29/02

[52] U.S. Cl. ..... 104/6; 104/2

[58] Field of Search ..... 104/2, 4, 6, 9

[56] References Cited

U.S. PATENT DOCUMENTS

| | | | |
|---|---|---|---|
| 3,437,052 | 4/1969 | Holley | 104/9 |
| 3,877,384 | 4/1975 | Fearon et al. | 104/6 |
| 4,046,077 | 9/1977 | Theurer et al. | 104/2 |

FOREIGN PATENT DOCUMENTS

| | | | |
|---|---|---|---|
| 238243 | 6/1964 | Austria | 104/6 |

*Primary Examiner*—Richard A. Bertsch

*Attorney, Agent, or Firm*—Kurt Kelman

[57] ABSTRACT

A traveling gantry arrangement for receiving, storing and transporting sets of transversely positioned track ties on a vertically adjustable tie carrier frame has a pair of tie-engaging grippers arranged on the frame for power-driven movement transverse to the track into engagement with the respective tie ends. The tie engaging grippers have support faces of a first width subtending the tie ends, and a pivotal support ledge for each tie end is associated with each tie engaging gripper. The support ledge has a second width substantially exceeding the first width, the widths being measured transverse to the track. A pivot extends in the direction of the track for pivotally supporting a respective support ledge for pivoting in a plane transverse to the track, and a drive pivots the support ledge about the pivot in the transverse plane.

4 Claims, 4 Drawing Figures

MOBILE TRACK TIE TRANSPORT APPARATUS WITH TRAVELING GANTRY

Figures 1, 2, 3, 4:
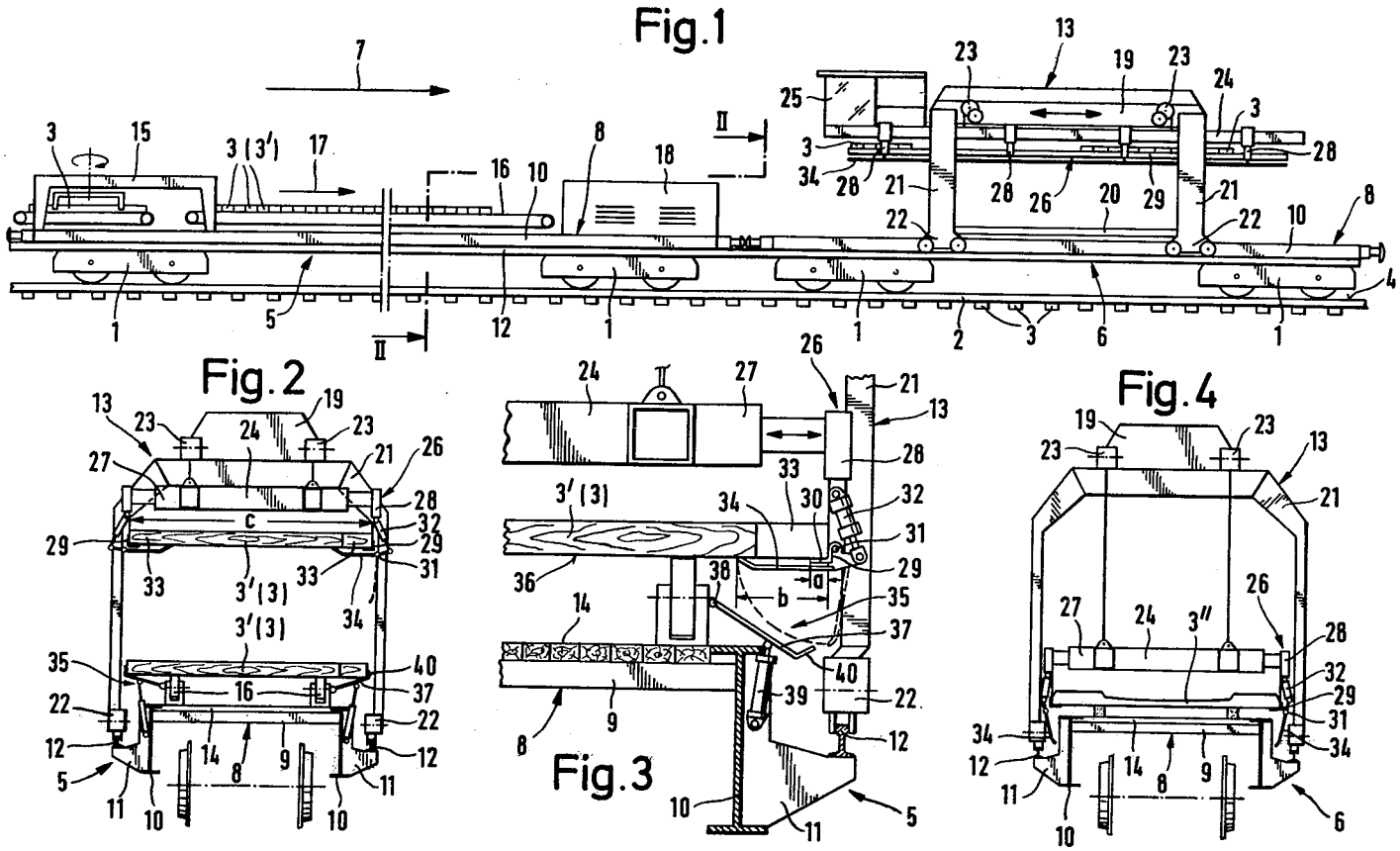

The present invention relates to improvements in a mobile apparatus for transporting track ties.

In our copending U.S. patent application Ser. No. 844,638, filed Oct. 25, 1977, now U.S. Pat. No. 4,152,990, we have disclosed a mobile apparatus for transporting track ties, which comprises a traveling gantry arrangement with a drive for moving the gantry arrangement in the direction of track elongation and including a gantry frame having means for receiving, storing and transporting sets of the track ties extending in a direction transverse to the direction of track elongation in a plane. The track tie receiving, storing and transporting means includes a tie carrier frame mounted for vertical adjustment on the gantry frame with a drive for vertically adjusting the tie carrier frame on the gantry frame. Tie holding means is mounted on the carrier frame for receiving, storing and transporting a respective one of the sets of track ties in the plane, and this tie holding means has a pair of tie engaging elements arranged for powerdriven movement transverse to the direction of track elongation with respective ones of the ends of the ties in the plane. In U.S. Pat. No. 4,046,077, dated Sept. 6, 1977, we disclosed a track renewal method and apparatus which includes a flat car on which ties are stored and which incorporates a traveling gantry arrangement for receiving and transporting the ties. The disclosures of our prior patents are incorporated herein by reference.

Austrian patent No. 238,243, published June 15, 1964, discloses an apparatus for constructing, laying and receiving assembled track sections. The apparatus comprises two gantry cranes which are coupled together by coupling rods and are movable along auxiliary rails. The gantry cranes are equipped with vertically adjustable beams which have gripping mechanisms for assembled track sections as well as disassembled rails or ties. The pivotal gripping jaws for engaging the ends of the ties may be laterally adjusted for adaptation to the length of the concrete ties to be gripped. However, this arrangement is not useful for receiving, storing and transporting old ties, particularly wooden ties, which must be handled during a track renewal operation since the lengths of such worn ties often differs considerably. This results particularly from the fact that, during a track renewal operation, only selected defective wooden ties are replaced by new ties of a different length. Tie gripping mechanisms set for a substantially uniform tie length are, therefore, incapable of receiving and securely holding a series of old ties whose length may deviate substantially from the set distance between the grippers. Under these circumstances, shorter ties may be gripped only at one end or not at all. If they are barely gripped at first, they may be shaken loose and drop during their transport, due to the movements of the traveling gantry. This may constitute a danger to the operating personnel, interrupt the track renewal operations and cause damage to structures in the way of falling ties.

It is the primary object of this invention to improve the type of mobile apparatus for transporting track ties first mentioned hereinabove so that it may operate safely and securely with ties of widely varying lengths, and which may be readily used in track renewal trains for this reason.

The above and other objects and advantages are accomplished according to the invention with tie engaging elements having support faces of a first width subtending the ends of the ties, and further comprising a pivotal support ledge for each tie end associated with each one of the tie engaging elements, the support ledges having a second width substantially extending the first width, the widths being measured transversely to the track elongation. A pivot extends in the direction of track elongation for pivotally supporting a respective one of the support ledges for pivoting in a plane extending transversely of the track elongation, and a drive pivots the support ledge about the pivot in the transverse plane.

The construction makes possible the transport of ties of substantially differing lengths without problems or danger, and without requiring any adjustments of the basic tie holding mechanism. The latter is used, as heretofore, for engaging sets of ties of substantially equal length while the support ledges are pivoted into a lowered rest position. All that is required for working with ties of differing lengths is the pivoting of the support ledges into their upper or working position in which they subtend the tie ends for support thereof. Furthermore, the support ledges may be readily mounted on tie holding means of existing traveling gantry arrangements of this type, which is an additional advantage of the present invention.

The above and other objects, advantages and features of this invention will become more apparent from the following detailed description of a now preferred embodiment thereof, taken in conjunction with the accompanying schematic drawing wherein FIG. 1 is a partial side elevational view of a track renewal train incorporating the mobile track tie transport apparatus of the invention, FIG. 2 is an enlarged section of the apparatus along line II—II of FIG. 1, illustrating a first working position, FIG. 3 is a further enlarged partial view of FIG. 2, illustrating a second working position, and FIG. 4 is similar to FIG. 2 but illustrates a third working position.

Referring now to the drawing and first to FIG. 1, there is shown a rear portion of a track renewal train operating in the direction of arrow 7, this rear train portion consisting of flat cars 5 and 6 which are coupled together and run on two-axles swivel trucks 1 along track 4 consisting of rails 2 and ties 3. Each flat car has a frame 8 consisting essentially of crossbeams 9 interconnecting longitudinal I-beams 10 and platform 14 supported on the crossbeam between the I-beams. The I-beams carry laterally projecting support webs 11 carrying auxiliary guide rails 12 for traveling gantry crane arrangement 13 with a drive for moving the gantry arrangement in the direction of track elongation.

The gantry arrangement includes a gantry frame consisting of two gantry frame parts 21, 21 interconnected with longitudinal gantry frame parts 19, 20 and running on wheel assemblies 22 along auxiliary guide rails 12. The gantry frame has means for receiving, storing and transporting sets of the track ties extending in a direction transverse to the direction of track elongation in a plane. The track tie receiving, storing and transporting means includes tie carrier frame 24 mounted for vertical adjustment on the gantry frame with drive consisting of cables winches 23, 23 for vertically adjusting the tie carrier frame on the gantry frame.

Tie holding means 26 is mounted on carrier frame 24 for receiving, storing and transporting a respective one of the sets of track ties in the plane, and this tie holding means has a pair of tie engaging elements 28 arranged for power-driven movement transverse to the direction of track elongation with respective ones of the ends of the ties in the plane.

In the illustrated embodiment, means is provided for adjusting the distance between track engaging elements 28 to a maximum width c (see FIG. 2), the illustrated distance adjusting means being a drive 27 laterally adjustably mounting each tie engaging element 28 on carrier frame 24 which also has operator's cab 25 mounted at one end of the carrier frame. Each illustrated tie engaging element 28 consists of continuous carrier ledge 29 of L-shaped cross section and extending in the direction of track elongation, the ledge having a substantially horizontally extending support face 30 (see particularly enlarged FIG. 3) projecting towards the center of the track. The support face of each track engaging element 28 has a width a (see FIG. 3) subtending a respective end of ties 3' (3). When all the ties of a set to be transported by the traveling gantry are of substantially the same length capable of being securely gripped by the pair of cooperating carrier ledges 29, (as shown in FIG. 4), they alone are used.

To enable the traveling gantry to transport worn ties removed from an old track during a track renewal operation while securely gripping and holding sets of old ties of carrying lengths, the present invention provides pivotal support ledge 34 for each tie end 33 associated with each tie engaging element 28. Support ledges 34 have a width b (see FIG. 3) substantially exceeding width a of support face 30, widths a and b being measured transversely to the track. Pivot 31 extending in the direction of track elongation pivotally supports a respective support ledge 34 for pivoting in a plane extending transversely of the track elongation and drive 32 is linked to the support ledge for pivoting the support ledge about pivot 31 in the transverse plane. In the illustrated embodiment, the ratio of width a to width b is about 1:4. As will be seen by reference to FIG. 2, width b is about one seventh of maximum width c between track engaging elements 28, which relationship will assure that even very short ties 3' will be held securely engaged during transport by resting at least one of their ends 33 on a support ledge 34.

The auxiliary support ledges of this invention may be readily installed on existing traveling gantries at relatively low cost. The indicated preferred width ratio between the support faces of the existing tie engaging elements and the auxiliary support ledges corresponds largely to prevailing track conditions, taking into account the most unfavorable differences in the lengths of worn ties removed during track renewal. In addition, these width ratio also assures a favorable spatial interrelationship enabling free pivotal movement of the support ledges between their lowered rest position and their upper operating position in the relatively crowded space available. This is of particular importance in the case the support ledges are installed on existing gantries.

Other operating aspects may also be taken into consideration in determining the width of support ledges 34. For instance, to adapt the apparatus for work on standard- as well as narrow-gage tracks, it will be desirable to make width b correspond substantially to the difference in the length of ties used in standard-gage and narrow-gage tracks.

In the illustrated embodiment and preferably, the mobile track tie transport apparatus of the invention is used in conjunction with, and as a part of, a track renewal train formed of a plurality of track-bound cars 5 and 6 (only the last one of cars 6 being illustrated), and a track consisting of guide rails 12 is mounted on the cars for moving gantry arrangement 13 in the direction of track elongation between the cars. Rear car 5 carries a tie transfer station where old ties 3 are received on a turntable device 15 in a position extending in the direction of the track and are turned 90° to extend transversely of the track, in which position they are transferred to longitudinal conveyor 16 mounted on platform 14 of flat car 5. The forward speed of conveyor 16 moving in the direction of arrow 17 is so correlated with the rate of tie delivery from turntable 15 that ties 3 and 3' (standard length and short ties) are conveyed on the conveyor in a set of abutting ties, as shown in FIG. 1, successive sets of these ties being received intermittently by traveling gantry arrangement 13 which is moved for this purpose into the range of conveyor 16, all as well known. Power plant 18 is also mounted on flat car 5 for operating turntable 15 and conveyor 16.

In the preferred embodiment illustrated herein, tie centering means 35 is arranged in the range of tie conveyor 16. Centering of the ties in each set in cooperation with the pivotal auxiliary support ledges on the transport gantry assures an absolutely trouble-free operation even when the lengths of the ties in the set differ considerably. The centering means positions the ties so that none has an end projecting beyond the lateral bounds determined by the centering means so that, when tie carrier frame 24 is lowered into position for receiving the set of ties from conveyor 16, the tie engaging elements at both ends of the ties may pass unhindered through the narrow space defined between the sides of the gantry crane and the tie ends.

The illustrated tie centering means includes a pair of centering ledges 37 extending below plane 36 defined by the support face of conveyor 16 for the ties. Each centering ledge 37 has an inner end closer to the center of track 4 and an outer end more remote therefrom. Pivot 38 extends in the direction of track elongation for pivotally supporting the inner end of each centering ledge 37 for pivoting in a plane extending transversely of the track. Drive 39 is linked to each centering ledge for pivoting the centering ledge between a tie engaging position (shown in FIG. 2) and a lowered position (shown in FIG. 3) about pivot 38 in the transverse plane. Abutment 40 projects upwardly from the outer end of each centering ledge for engagement with a respective tie end face, as illustrated in FIG. 2. As can be readily seen in FIG. 3, support ledge 34 are arranged for pivoting from a rest position shown in broken lines into engagement with tie ends 33 (shown in full lines) when centering ledges 37 are in the lowered position. This condition may be readily met since the required minimum height of conveyor 16 leaves sufficient space below tie support plane 36 to permit centering ledges 37 to be pivoted out of the way of the pivoting path of support ledges 34.

Centering of the ties on conveyor 16 is accomplished by upwardly pivoting both centering ledges 37 by operation of drives 39 so that the end faces of the ties are engaged by abutments 40, thus preventing any tie from sticking out laterally beyond the boundaries defined by the abutments. Short ties 3' will automatically be within these boundaries and standard ties 3 will be centered.

The operation of the apparatus will generally be obvious from the above description of its structure and will be further elucidated hereinafter:

As soon as a set of ties has been assembled on longitudinal conveyor 16 (see FIG. 1), further conveying movement of the conveyor in the direction of arrow 17 is halted. Drives 39 are now actuated to operate tie centering means 35, thus assuring lateral alignment of all the ties ends within the lateral boundaries defined by abutments 40 of the centering means. The centering ledged are then lowered by drives 39 into the rest position shown in FIG. 3. Meanwhile, gantry arrangement 13 has been moved from a position on one of the cars 6 of the track renewal train along guide rails 12 to car 5 and is stopped when conveyor 16 extends through the gantry crane so that the crane is in a position to receive the set of ties from the conveyor. Before tie carrier frame 24 is lowered, support ledges are pivoted into their lower rest position (shown in broken lines in FIG. 3 and in full lines in FIG. 4) by actuating drives 32. The desired maximum width c of tie holding means 26 is now adjusted by actuating of lateral adjustment drives 27 which move tie holding elements 28 into the desired lateral position.

With these adjustments completed, winches 23 are operated to lower tie carrier frame 24 until support faces 30 of tie carrier ledges 29 are positioned below support plane 36 of the set of ties. Drives 27 are now actuated to move tie engaging elements 28 towards each other until support faces 30 subtend tie ends 33 (of the standard ties). Finally, drives 32 are operated to pivot support ledges 34 upwardly (see full lines in FIG. 3) into a horizontal position wherein they subtend the ends of shorter ties so that all the ties in the set are securely held on tie holding means 26. Winches 23 are now again operated to raise tie carrier frame 24 which now carries the set of ties securely held on tie holding means 26. Gantry arrangement 13 is now moved forward in the direction of arrow 7 to a car 6 designated to receive and store the ties in a known manner.

As is also known, the operation of the tie transport will be greatly rationalized if gantry arrangement 13 on its return trip to rear car 5 carries a set of new ties 3'' (see FIG. 4) which it picks up from one of the cars 6 on which such new ties are stored so that the new ties may be laid behind rear car 5 where the old ties have been removed.

What is claimed is:

1. A mobile apparatus for transporting track ties, which comprises a traveling gantry arrangement with a drive for moving the gantry arrangement in the direction of track elongation and including a gantry frame having means for receiving, storing and transporting sets of the track ties extending in a direction transverse to the direction of track elongation in a plane, the track tie receiving, storing and transporting means including a tie carrier frame mounted for vertical adjustment on the gantry frame with a drive for vertically adjusting the tie carrier frame on the gantry frame, and tie holding means mounted on the carrier frame for receiving, storing and transporting a respective one of said sets of track ties in said plane, the tie holding means having a pair of tie engaging elements arranged for power-driven movement transverse to the direction of track elongation into engagement with respective ones of the ends of the ties in said plane, wherein (a) the tie engaging elements have support faces of a first width subtending the ends of the ties, and further comprising (b) a pivotal support ledge for each tie end associated with each one of the tie engaging elements, the support ledges having a second width substantially exceeding the first width, the widths being measured transversely to the track elongation, (c) a pivot extending in the direction of track elongation for pivotally supporting a respective one of the support ledges for pivoting in a plane extending transversely of the track elongation, and (d) a drive for pivoting the support ledge about the pivot in the transverse plane.

2. The mobile apparatus for transporting track ties of claim 1, further comprising means for adjusting the distance between the track engaging elements to a maximum width, and the second width being about one seventh of the maximum width between the track engaging elements.

3. The mobile apparatus for transporting track ties of claim 1 or 2, wherein the second width substantially corresponds to the difference in the length of ties used in standard-gage and narrow-gage tracks.

4. The mobile apparatus for transporting track ties of claim 1 or 2, comprising a plurality of track-bound cars forming a train, a track mounted on the cars for moving the gantry arrangement in the direction of track elongation between said cars, a longitudinally extending conveyor mounted on one of said cars for receiving and transporting said sets of track ties, the track ties substantially abutting each other in said plane on the conveyor, and a tie centering means arranged in the range of the conveyor, the centering means including a pair of centering ledges extending below said plane, each centering ledge having an inner end closer to the center of the track and an outer more remote therefrom, a pivot extending in the direction of track elongation for pivotally supporting the inner end of each centering ledge for pivoting in a plane extending transversely to the track, a drive for pivoting the centering ledge between a tie engaging and lowered position about the pivot in the transverse plane, and an abutment upwardly projecting from the outer end of each centering ledge for engagement with a respective tie end face, the support ledges being arranged for pivoting into engagement with the tie ends in the lowered position of the centering ledges.

* * * * *